US008051880B2

(12) United States Patent
Nagaoka et al.

(10) Patent No.: US 8,051,880 B2
(45) Date of Patent: Nov. 8, 2011

(54) REINFORCING BAR BINDING MACHINE

(75) Inventors: Takahiro Nagaoka, Tokyo (JP); Tsuyoshi Kobayashi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 261 days.

(21) Appl. No.: 12/467,453

(22) Filed: May 18, 2009

(65) Prior Publication Data

US 2009/0283171 A1 Nov. 19, 2009

(30) Foreign Application Priority Data

May 19, 2008 (JP) ..... 2008-130640
Feb. 10, 2009 (JP) ..... 2009-028657

(51) Int. Cl.
*B21F 9/02* (2006.01)
*B21F 15/04* (2006.01)

(52) U.S. Cl. ..... 140/57; 140/119; 100/31

(58) Field of Classification Search ..... 140/57, 140/93 A, 119; 100/31; 53/138.6, 138.8
See application file for complete search history.

(56) References Cited

U.S. PATENT DOCUMENTS

| | | | | |
|---|---|---|---|---|
| 5,279,336 | A | 1/1994 | Kusakara et al. | |
| 5,826,629 | A * | 10/1998 | West | 140/119 |
| 5,947,166 | A * | 9/1999 | Doyle et al. | 140/119 |
| 7,051,650 | B2 * | 5/2006 | Kusakari et al. | 100/31 |

FOREIGN PATENT DOCUMENTS

| | | |
|---|---|---|
| EP | 0 751 269 A1 | 1/1997 |
| EP | 0 886 020 A1 | 12/1998 |
| EP | 1 415 917 A1 | 5/2004 |
| GB | 825 433 | 12/1959 |
| JP | 5-92106 | 12/1993 |
| JP | 7-2201 | 1/1995 |
| JP | 3496463 | 11/2003 |

* cited by examiner

*Primary Examiner* — Jimmy T Nguyen
(74) *Attorney, Agent, or Firm* — Drinker Biddle & Reath LLP

(57) ABSTRACT

A reinforcing bar binding machine is provided with: a main sleeve having a tip end on which a hook is pivotally mounted; a tip end shaft fitted in an inside of the main sleeve; a spiral screw groove formed on the tip end shaft; a fitting opening that penetrates from an outside to the inside of the main sleeve; a key fitted in the fitting opening and brought in mash engagement with the screw groove; a short sleeve provided on an outer periphery of the main sleeve and covering the key; and an engaging means formed on the short sleeve and controlling a rotation of the main sleeve.

12 Claims, 11 Drawing Sheets

REINFORCING BAR BINDING MACHINE

BACKGROUND OF THE INVENTION

1. Field of the Invention

The present invention relates to a reinforcing bar binding machine including a binding device which binds arranged reinforcing bars by twisting a wire looped and wound around the reinforcing bars.

2. Background Art

In a reinforcing bar arrangement process of a reinforced concrete construction work, as a tool for binding reinforcing bars at a crossing point, etc., of reinforcing bars, a reinforcing bar binding machine is known. This reinforcing bar binding machine is provided with a binding device for binding reinforcing bars. As shown in JP-B2-3496463, this binding device includes a sleeve which is provided inside the binding machine body and has reinforcing bar binding hooks pivotally mounted to the tip end, a tip end shaft which is fitted to the inside of the sleeve and generates a load for advancing and retreating and rotating the sleeve, and engaging means (fins) for controlling the rotation of the sleeve in cooperation with rotation stoppers provided on the binding machine body, and advances the sleeve by rotating the tip end shaft by a motor, and accordingly, closing and actuating the hooks to make the hooks grasp the reinforcing bar binding wire, and further rotates the hooks together with the sleeve to twist the wire and bind the reinforcing bars.

In the binding mechanism described above, the sleeve has a double structure including an outer sleeve and an inner sleeve, and the front portion of the outer sleeve holds the hooks rotatably and the rear portion of the outer sleeve prevents the key engaging with a screw groove of the tip end shaft from coming out, and to the front portion of the inner sleeve, a shaft for holding a guide pin for opening and closing the hooks is attached, and the rear portion holds the key in a fitting manner. The outer sleeve and the inner sleeve are actuated integrally, so that for integrating these sleeves, as shown in FIG. 11, a set screw 53 is screwed into the inner sleeve 52 from the outer sleeve 51.

However, according to the configuration described above, between the tip end shaft and the hooks which actually grasp and twist the wire, four components such as the tip end shaft 54, the key 55, the inner sleeve 52, the set screw 53, the outer sleeve 51, and the hooks 56 are interposed, and this makes the structure complicated.

A load is transmitted from the inner sleeve to the outer sleeve via the set screw 53, however, downsizing takes precedence, so that a large-sized fixing tool cannot be used, and the set screw 53 easily loosens during repeated use.

A pair of hooks 56 (one is not shown) are attached to the front end of the outer sleeve 51, and the rear portion of the outer sleeve covers the key 55 and prevents it from coming out toward the outer periphery, so that the outer sleeve is inevitably formed to be long in the front-rear direction outside the inner sleeve 52, and this double structure cannot be avoided, so that the diameter inevitably becomes large and the weight is also heavy.

In addition, a compression spring 57 is installed between the inner sleeve 52 and the tip end shaft 54 so that the hooks 56 come to predetermined opening positions in an initial state, and between these components, resistance is generated to some degree so that the inner sleeve 52 easily rotates together with the tip end shaft 54, however, the compression spring 57 is disposed inside the inner sleeve, so that the spring load cannot be increased.

Further, in the wire twisting mechanism, the tip end shaft is fitted to the inside of the sleeve, and the rotation of the tip end shaft is converted to advancing and retreating and rotation of the sleeve, and in particular, when the sleeve retreats to a standby position after finishing a twisting operation, the two hooks must be positioned at predetermined angles, that is, at both sides of the wire at the advancing end of the sleeve. Therefore, in the latter half of retreating movement of the sleeve, one fin of the sleeve and rotation stoppers of the binding machine body are disengaged and the sleeve retreats while rotating, and when the other fin engages with the rotation stoppers and the hooks come to the predetermined angles, the standby state is obtained. In rotation after the disengagement, a spring collar and a compression spring are provided between a jutting part provided on the base portion of the tip end shaft and the sleeve, the spring collar is pressed against the sleeve by a compression load of the compression spring along with the retreating movement of the sleeve, and due to a frictional force between these, the tip end shaft and the sleeve are rotated together.

However, the sleeve is supported rotatably on a support member provided on the reinforcing bar binding machine main body and engaged with other members. Normally, between the sleeve and these members, grease is applied, so that the frictional force is maintained small, however, the grease becomes insufficient in some cases. In the operation environment of the reinforcing bar binding machine, fine debris and fugitive dust float, so that the grease may absorb fine debris and fugitive dust. In these cases, the lubricating function is deteriorated and the frictional force between the sleeve and the members increase, and a phenomenon easily occurs in which the sleeve cannot rotate together with the tip end shaft and the hooks cannot completely return to the standby positions. If the hooks cannot return to the standby positions, due to the incorrect orientations of the hooks, the wire cannot be grasped during the twisting operation, and a twisting failure may occur. To prevent this phenomenon, it is necessary to use a thick compression spring with a great spring load and increase the frictional force between the sleeve and the tip end shaft by adding components, and this makes the structure large in size and complicated, and results in a cost increase.

SUMMARY OF THE INVENTION

One or more embodiments of the invention provide a reinforcing bar binding machine including a binding device which has a simplified structure and is reduced in size and weight, and can sufficiently bear a high load.

Moreover, one or more embodiments of the invention provide a reinforcing bar binding machine in which hooks of the sleeve can be correctly returned to predetermined standby positions by reliably rotating the sleeve and the tip end shaft together by a simple structure after wire twisting.

In accordance with one or more embodiments of the invention, a reinforcing bar binding machine is provided with: a main sleeve 11 having a tip end on which a hook 10 is pivotally mounted; a tip end shaft 12 fitted in an inside of the main sleeve 11; a spiral screw groove 14 formed on the tip end shaft 12; a fitting opening 13 that penetrates from an outside to the inside of the main sleeve 11; a key 15 fitted in the fitting opening 13 and brought in mash engagement with the screw groove 14; a short sleeve 16 provided on an outer periphery of the main sleeve 11 and covering the key 15; and an engaging means 33, 34 formed on the short sleeve 16 and controlling a rotation of the main sleeve 11.

In the above configuration, the hooks are pivotally mounted to the front end of the main sleeve to which the tip end shaft is fitted, and the key on the rear portion is prevented from coming out by the short sleeve, so that unlike the conventional configuration, there is no need to lengthen the outer sleeve, and only the single main sleeve is made long. Therefore, the structure becomes simple and slim, so that the size and weight can be reduced.

The load is transmitted from the tip end shaft to the hooks in the order of the tip end shaft, the key, the main sleeve, and the hooks, so that only two components are interposed. Further, the main sleeve and the short sleeve can be engaged integrally, and unlike the conventional configuration, there is no need to fix these with a fixing tool, so that the fixing tool interposed between the two inner and outer sleeves in the conventional configuration becomes unnecessary, and a high load can be transmitted by a simple structure.

Further, a bumper is provided at the rear of the main sleeve and comes into contact with the main sleeve via spring collars, so that when the main sleeve retreats, the contact area between the bumper and the spring collars can be secured large, so that an impact can be satisfactorily absorbed.

The short sleeve 16 may include a short sleeve main body 16*m* and a stopper sleeve 45, and an out side of the key 15 may be covered by the stopper sleeve 45

In the above configuration, the outside of the key is covered by the exclusive stopper sleeve, so that the sleeve is formed of a simple annular body.

Front and rear ends of the stopper sleeve 45 may respectively engage with a rib 48 formed on the outer periphery of the main sleeve 11 and the short sleeve 16.

In the above configuration, the front and rear ends of the stopper sleeve engage with a rib formed on the outer periphery of the main sleeve and the short sleeve, respectively, so that the rotation of the main sleeve can be transmitted to the short sleeve indirectly via the stopper sleeve.

The main sleeve 11 and the short sleeve 16 may be engaged with each other by key coupling.

In the above configuration, the main sleeve and the short sleeve are engaged with each other by key coupling, so that the rotation of the main sleeve can be transmitted directly to the short sleeve.

The reinforcing bar binding machine may further include a cutter ring 32 which fits on the outer periphery of the main sleeve 11 and actuates a cutter of a wire, and the cutter ring 32 may sandwiched and fixed between the short sleeve 16 and a stopper ring 29 attached on the main sleeve 11.

In the above configuration, a cutter ring which actuates a cutter of the wire is fitted to the outer periphery of the tip end shaft, and the cutter ring is sandwiched and fixed between the short sleeve and a stopper ring attached to the tip end shaft, so that the cutter ring can be easily attached.

The reinforcing bar binding machine may further includes: a spring collar 40, 41 fitting on the tip end shaft 12; and a compression spring 37 provided between a planet cage 27 coupled to a rear end of the tip end shaft 12 for rotatably supporting a planet gear configuring a speed reduction mechanism of a drive motor 17 and a rear end of the main sleeve 11, and disposed on an outer side of the spring collar 40, 41.

In the above configuration, between a planet cage rotatably supporting planet gears which are coupled to the rear end of the tip end shaft and constitutes a speed reduction mechanism of a drive motor and the rear end of the main sleeve, a compression spring is disposed, and the compression spring is engaged with the outside of spring collars fitted to the tip end shaft, so that the thickness of the compression spring can be freely changed to obtain an optimum spring force.

The planet cage 27 and the tip end shaft 12 may be coupled by a parallel pin 28, and the parallel pin 28 may be prevented from coming out by a bearing portion 30 of the planet cage 27.

In the above configuration, the planet cage and the tip end shaft are coupled by a parallel pin, and the parallel pin is prevented from coming out by a bearing portion of the planet cage, so that the tip end shaft can be fixed easily and reliably.

A bumper 42 may be provided between the planet cage 27 and a rear spring collar 41.

In the above configuration, a bumper is provided between the planet cage and the rear spring collar, so that an impact when the main sleeve retreats can be efficiently absorbed.

Furthermore, in accordance with one or more embodiments of the invention, a reinforcing bar binding machine is provided with: a sleeve 11, 16 having a tip end on which a hook 10 is pivotally mounted; a long fin 33 which is long in an axial direction of the sleeve 11, 16 and a short fin 34 which is short in the axial direction, the long and short fins 33 being formed on the sleeve 11, 16 at intervals in a circumferential direction of the sleeve 11, 16; a tip end shaft 12 fitted in an inside of the sleeve 11, 16; a spiral screw groove 14 formed on the tip end shaft 12; a fitting opening 13 that penetrates from an outside to the inside of the sleeve 11, 16; a key 15 fitted in the fitting opening 13 and brought in mash engagement with the screw groove 14; a rotation stopper 35 provided on a binding machine body 1 and engageable with the long and short fins 33, 34; and a bumper 42 provided between a jutting part 27 provided on a base portion of the tip end shaft 12 and an end face of the sleeve 11, 16. When the long fin 33 engages with the rotation stopper 35, the sleeve 11, 16 advances with respect to the tip end shaft 12 by a rotation of the tip end shaft 12 so that the hook 10 grasps a wire W. When the sleeve 11, 16 retreats to a standby position by a reverse rotation of the tip end shaft 12 and the short fin 34 disengages from the rotation stopper 35, the tip end shaft 12 and the sleeve 11, 16 integrally rotate so that the long fin 33 engages with the rotation stopper 35 to set the hook 10 in a predetermined orientation. When the sleeve 11, 16 retreats, by a frictional force between the spiral screw groove 14 and the key 15 caused by colliding the sleeve 11, 16 with the bumper 42, the tip end shaft 12 and the sleeve 11, 16 integrally rotate.

In the above configuration, when the sleeve retreats, the sleeve is collided with the bumper provided between the jutting part provided on the base portion of the tip end shaft and the end face of the sleeve and the bumper is compressed, and accordingly, a great frictional force occurs between the spiral screw groove of the tip end shaft and the key of the sleeve. Even when the grease applied between the sleeve and members of the reinforcing bar binding machine main body side runs out or absorbs debris and fugitive dust and deteriorates the lubricating function and loses the smoothness of the actuation between these members and the frictional force between the sleeve and the members increases, the frictional force obtained by compressing the bumper is much greater than the frictional force between the sleeve and the members, so that while the structure is simple, the sleeve and the tip end shaft can be reliably rotated together to return the hooks to standby positions and set the hooks in predetermined orientations at standby angles.

In addition, it becomes possible to detach a compression spring for increasing the frictional force, so that the number of components can be reduced, and according to the space of the reduced component, the entire length is shortened, and downsizing is realized.

The sleeve 11, 16 may be collided with the bumper 42 at a controlled fixed number of rotations, after the short fin 34 and the rotation stopper 35 are disengaged when the sleeve 11, 16 retreats, and a drive motor 17 may be stopped based on a change in current or number of rotations when the bumper 42 is compressed by the collision.

In the above configuration, when the sleeve retreats from the front end position to the standby position, after the short fin and the rotation stoppers are disengaged, the sleeve is collided with the bumper at the controlled fixed number of rotations, and based on a change in current or number of rotations when the bumper is compressed by the collision, the drive motor is stopped, so that without losing the operation swiftness, while the impact is minimized, the durability of the components can be improved.

A drive motor 17 may controlled to rotate at a low speed immediately before the sleeve 11, 16 is collided with the bumper 42, after the short fin 34 and the rotation stopper 35 are disengaged when the sleeve 11, 16 retreats, and the drive motor 17 may stopped based on a change in current or number of rotations when the bumper is compressed by the collision.

In the above configuration, when the sleeve retreats, after the short fin and the rotation stoppers are disengaged, the drive motor of the tip end shaft is controlled to rotate at a low speed immediately before the sleeve is collided with the bumper, and at the low speed with the controlled number of rotations, the sleeve is collided with the bumper, so that until just before the sleeve collides with the bumper, the drive motor is rotated at a high speed, and immediately before the sleeve collides with the bumper, by lowering the number of rotations to a target number of rotations, the twisting operation can be performed in the shortest time without breaking the bumper, etc., so that the series of binding operation times can be shortened.

When the sleeve 11, 16 collides with the bumper, a change in current or number of rotations when the bumper is compressed may be monitored, and the drive motor 17 may be rotated at a fixed number of rotations and then stopped.

In the above configuration, collision of the sleeve with the bumper can be detected by monitoring a change in current or number of rotations when the bumper is compressed, so that a position detection sensor using a magnetic sensor, etc., becomes unnecessary, and the mechanism can be simplified and downsized.

Other aspects and advantages of the invention will be apparent from the following description, the drawings and the claims.

DETAILED DESCRIPTION OF THE EXEMPLARY EMBODIMENTS

Exemplary embodiments of the invention are described in reference to drawings.

Figure 1:
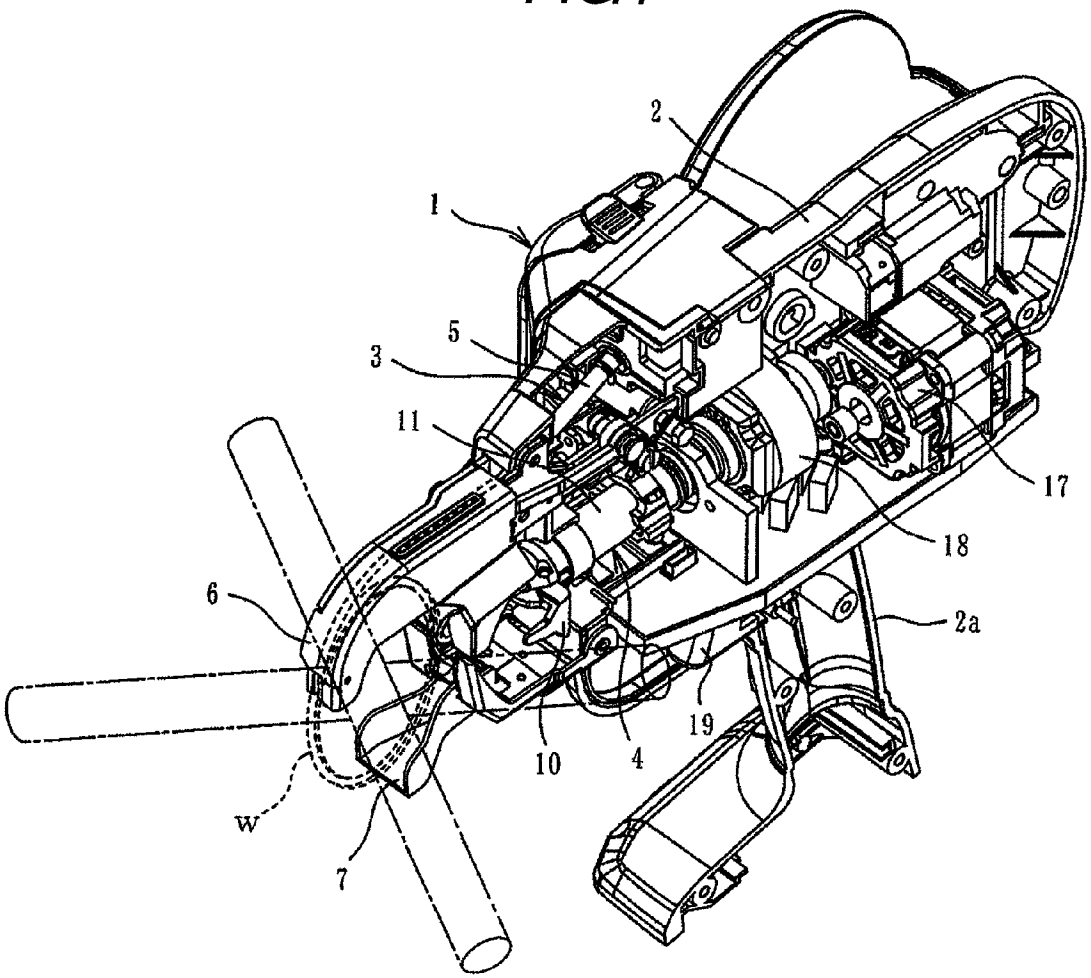
FIG. 1 is a perspective view showing an internal state of a reinforcing bar binding machine main body of an exemplary embodiment of the present invention.

FIG. 1 is a perspective view showing an internal state of a reinforcing bar binding machine main body, and this reinforcing bar binding machine main body 1 includes a reinforcing bar binding wire feeding device 3 and a wire binding device 4 installed in a housing 2, and a wire reel (not shown) rotatably pivotally mounted to a rear side surface of the housing 2.

The wire feeding device 3 feeds a wire w wound around a wire reel from a guide tube 5 to a wire guide 6 by a feed roller not shown, and curls the wire here and loops and winds the wire around reinforcing bars (not shown) between the wire guide 6 and a lower guide 7, and the wire binding device 5 grasps and twists a part of the looped wire w to bind the reinforcing bars, and the terminal end portions of the loop of the wire w are cut during actuation of the binding device 4.

The wire feeding device 3 and the wire binding device 4 are sequence-controlled by a control circuit (not shown), and by drawing a trigger 19 disposed at a grip portion 2*a* of the housing 2, performs an operation of one cycle including a wire feeding step and a twisting step.

Figure 2:
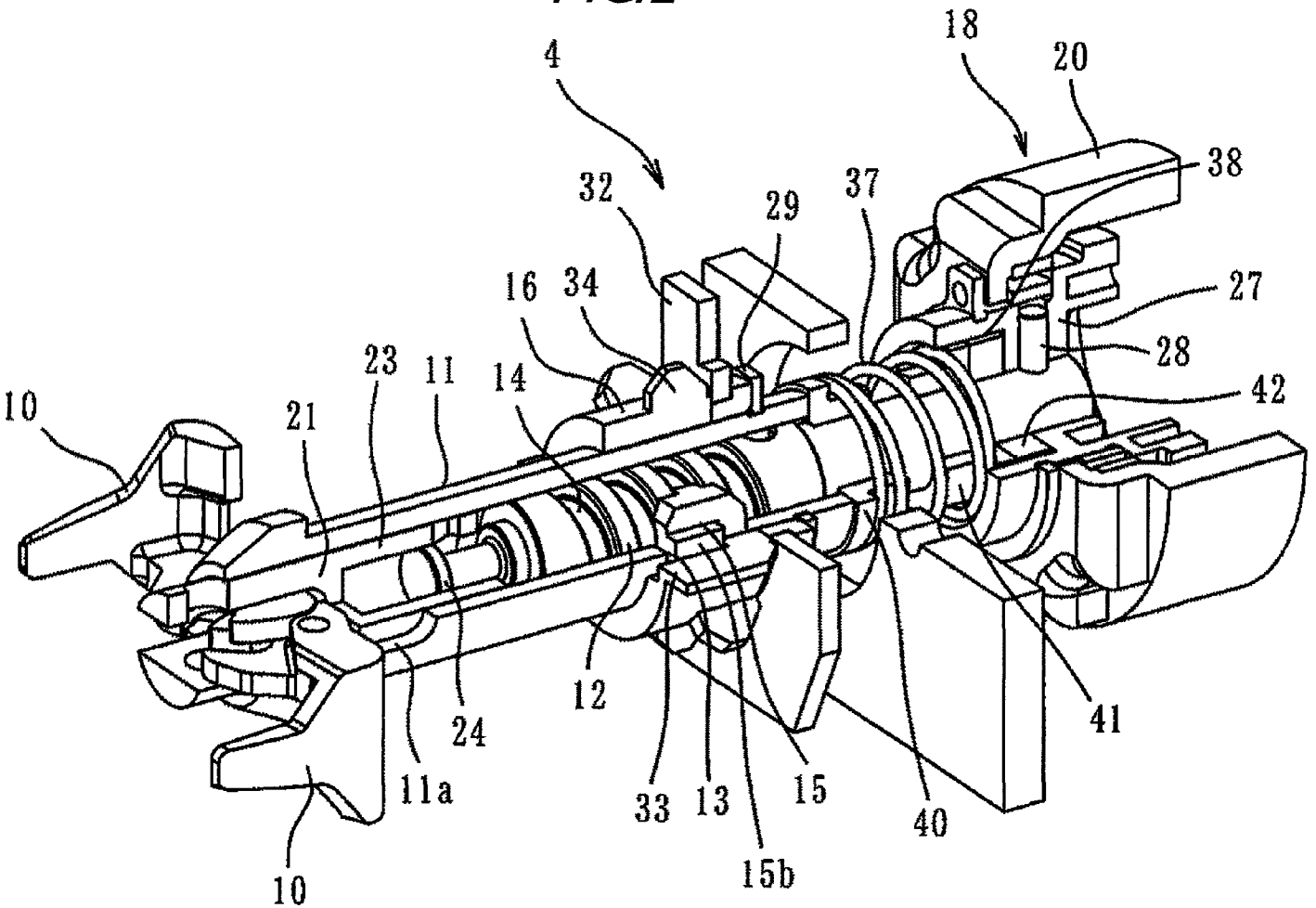
FIG. 2 is a perspective view showing a part of a wire twisting device in a section.
Figure 3B:
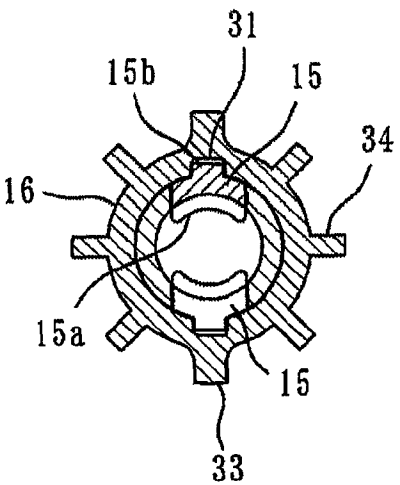
FIG. 3(*a*) is a longitudinal sectional view of the twisting device and FIG. 3(*b*) is a sectional view along X-X line of FIG. 3(*a*)
Figure 3A:
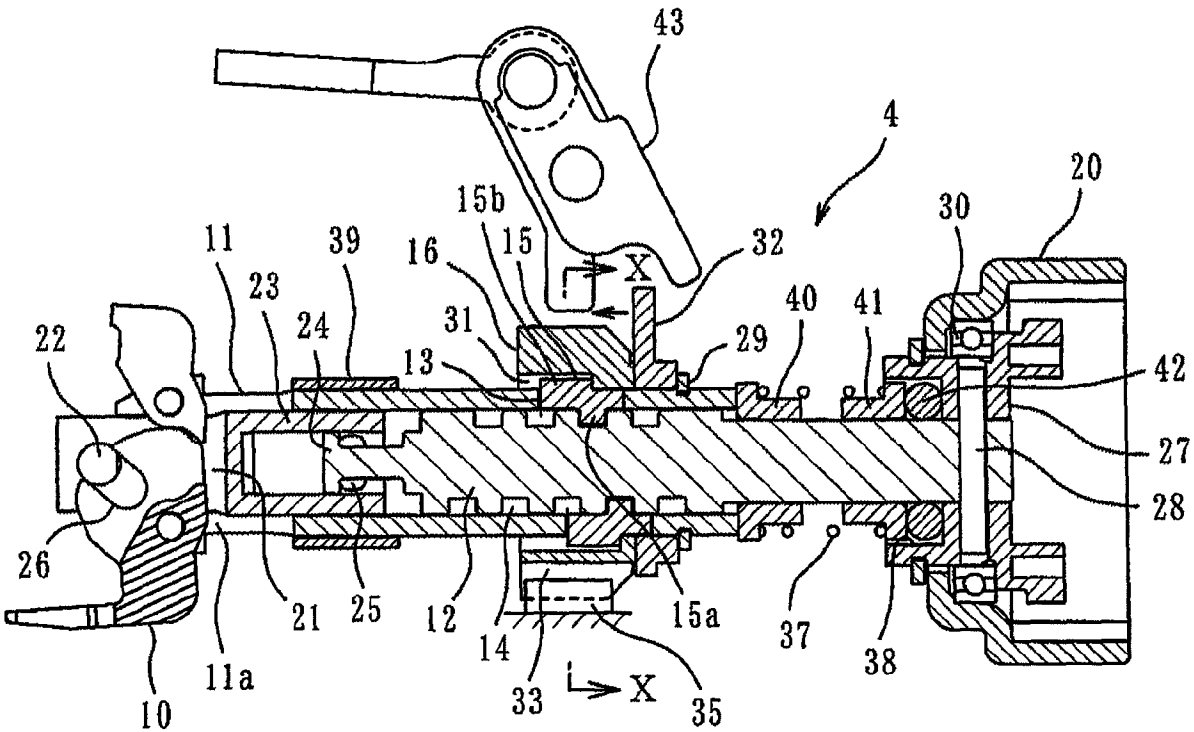

The wire binding device 4 includes, as shown in FIG. 2 and FIG. 3(*a*) and FIG. 3(*b*), a main sleeve 11 which is provided inside the binding machine body 1 and has reinforcing bar binding hooks 10 rotatably pivotally mounted to the tip end, a tip end shaft 12 which is fitted in the inside of the main sleeve 11 and generates a load for advancing and retreating and rotating the main sleeve 11, a key 15 which is fitted into a fitting opening 13 formed through the main sleeve 11 and engages with a screw groove 14 of the tip end shaft 12, and a short sleeve 16 which controls the rotation of the main sleeve 11 in cooperation with the binding machine body 1, and the tip end shaft 12 is joined to a speed reducer 18 which reduces the speed of rotation of an output shaft of a drive motor 17 (brushless motor) as shown in FIG. 1.

In other words, near the tip end portion of a slot 11*a* at the front portion of the main sleeve 11, a pair of hooks 10 are pivotally mounted on both sides of a shaft body 21 and disposed oppositely to each other. To a portion slightly rear of the middle portion of the main sleeve 11, a fitting opening 13 for two portions of a key 15 fit. The key 15 includes a key portion 15*a* which projects to the inside of the main sleeve 11 and engages with a screw groove 14 of the tip end shaft 12 described next, and a convex portion 15*b* projecting to the outside of the main sleeve 11.

On the tip end shaft 12, a spiral screw groove 14 is formed, Ahead of the tip end shaft 12, a shaft body 21 is provided. To the front portion of the shaft body 21, a guide pin 22 is fixed, and on the rear portion, a cylindrical part 23 is formed integrally, and inside the cylindrical part 23, a jutting part 24 formed on the front end of the tip end shaft 12 is fitted. The jutting part 24 is prevented from coming out by a stopper pin 25. The guide pin 22 engages with a guide groove 26 of the hooks 10.

The base portion of the tip end shaft 12 is fitted to the center of a planet cage 27 (jutting part), and coupled to the planet cage 27 integrally by a parallel pin 28. The parallel pin 28 is prevented from coming out by a bearing portion 30 of the planet cage 27. The planet cage 27 constitutes a speed reducer 18, and supports planet gears rotatably although this is not shown, and the planet gears engage with a sun gear, and the sun gear is joined to an output shaft of the drive motor 17. The reference numeral 20 denotes an internal gear which engages with the planet gears.

Next, the short sleeve 16 is fitted to the outer periphery of the main sleeve 11 at a position covering the outside of the key 15, and on the inner peripheral surface, an engaging groove 31 which engages with the convex portion 15*b* of the key 15 is formed. Accordingly, the key 15 is covered by the short sleeve 16 and prevented from coming out from the main sleeve 11. The groove end of the engaging groove 31 comes into contact with the convex portion 15*b*, and accordingly, the short sleeve 16 is restricted from moving forward.

To the rear portion of the short sleeve 16, a cutter ring 32 is fitted, and at the rear portion of the cutter ring 32, a C-shaped stopper ring 29 is attached to the main sleeve 11. Accordingly, the cutter ring 32 is fitted and slid from the rear end of the main sleeve 11 and fixed by the C-shaped stopper ring 29, so that the cutter ring is easily attached. The rear portion of the short sleeve 16 comes into contact with the cutter ring 32 and is restricted from moving further rearward. The cutter ring 32 is also sandwiched between the short sleeve 16 and the C-shaped stopper ring 29 and restricted from moving forward and rearward.

Figure 4:
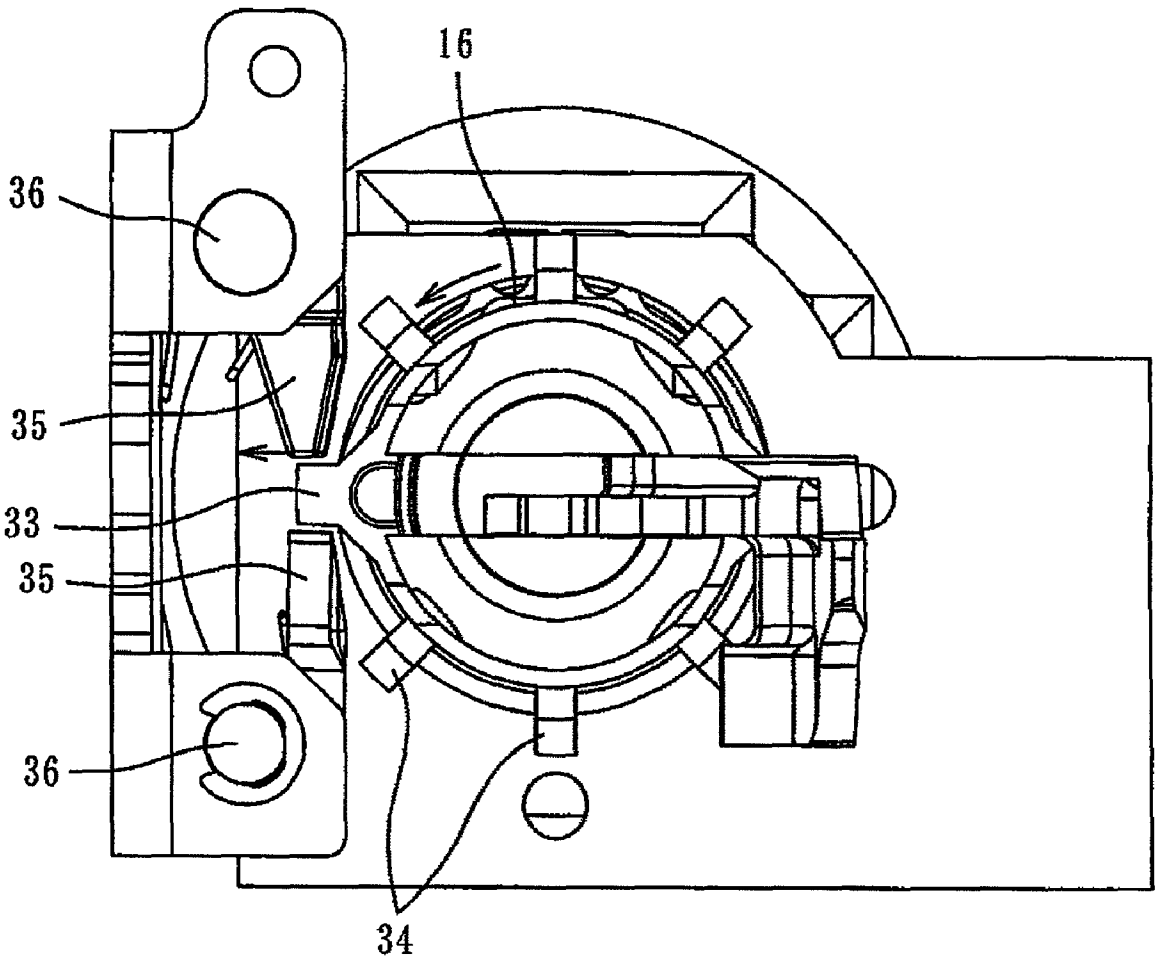
FIG. 4 is a front view of a short sleeve and rotation stoppers 5.

On the outer periphery of the short sleeve 16, two types of long and short fins 33 and 34 (engaging means 33, 34) are formed at intervals in the circumferential direction. The long fins 33 are provided at exact opposite positions of the short sleeve 16. On the other hand, as shown in FIG. 4, on the binding machine body 1, a pair of rotation stoppers 35 and 35 are disposed oppositely on the upper and lower positions corresponding to the fins 33 and 34. The rotation stoppers 35 and 35 can turn around shafts 36. Accordingly, when the short sleeve 16 rotates and the fin 33, 34 comes into contact with one rotation stopper, this rotation stopper turns so as not to interfere with the fin 33, 34, however, when the fin 33, 34 rotates further, it comes into contact with the other rotation stopper. The other rotation stopper cannot turn, so that the rotation of the short sleeve 16 is forcibly stopped. The rotation stoppers 35 and 35 are provided on the front half portion of the movement range of the short sleeve 16 which moves integrally with the main sleeve 11. Therefore, at the standby position, the long fin 33 is sandwiched between the rotation stoppers 35 and 35 and the short sleeve 16 cannot rotate and the two hooks 10 are held horizontally.

Next, between the main sleeve 11 and the planet cage 27, a compression spring 37 is disposed. In other words, on the front portion of the planet cage 27, a concave portion 38 is formed, and between the main sleeve 11 and the concave portion 38, two front and rear spring collars 40 and 41 are disposed while being fitted to the main sleeve 11. Outside these spring collars 40 and 41, the compression spring 37 is disposed.

Between the rear spring collar 41 and the concave portion 38 of the planet cage 27 on the base portion of the tip end shaft 12, a ring-shaped bumper 42 is disposed so as to fit around the tip end shaft 12. The bumper 42 is made of an elastic material such as rubber. The section of the bumper 42 may be circular or rectangular. Further, the reference numeral 39 denotes a guide sleeve for holding the main sleeve 11 slidably, and is fixed to the binding machine body 1 side.

Figure 5:
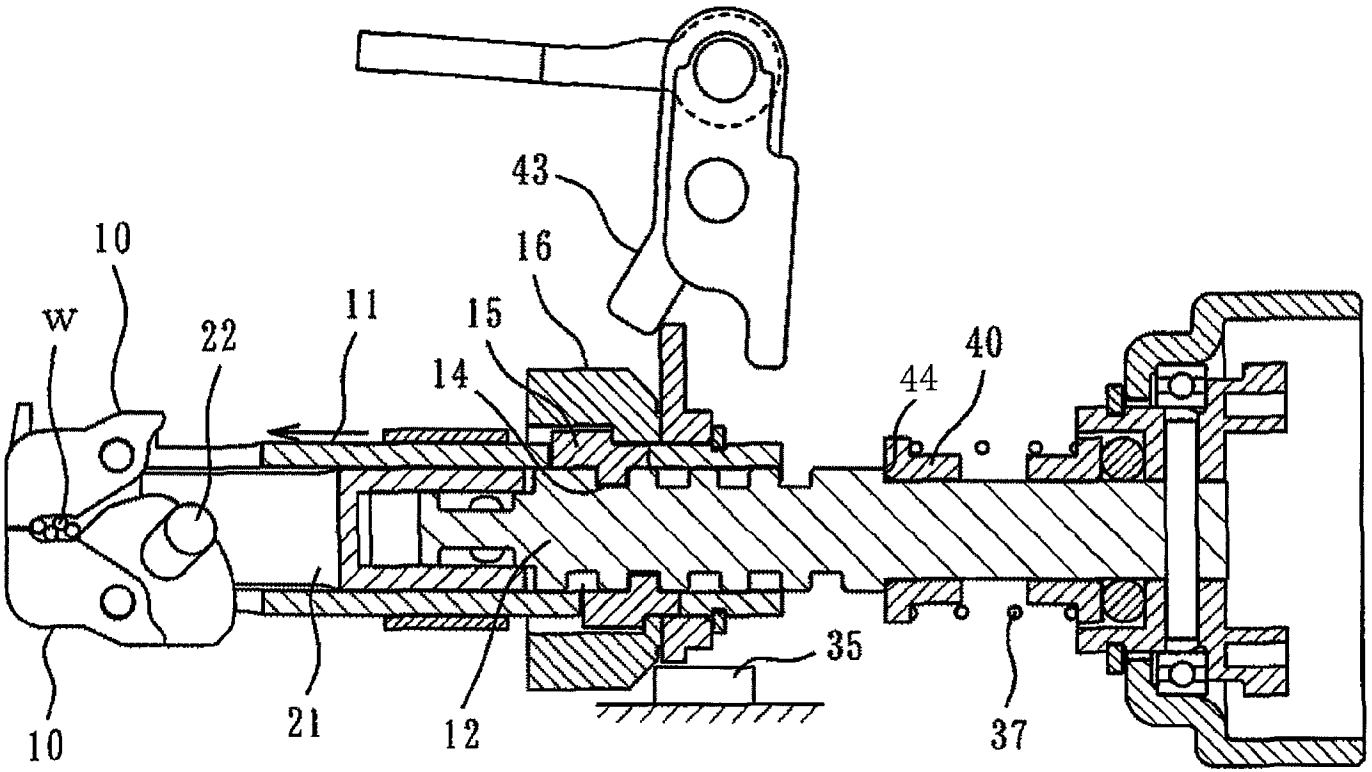
FIG. 5 is a sectional view showing a state where hooks grasp a wire.

Next, an actuation mode of the wire binding device configured as described above will be described. When a trigger 19 is pulled, as described above, the wire w is fed out by a predetermined amount according to the type of the wire w by the wire feeding device 3. The fed-out wire w is looped and wound by the wire guide 6 and the lower guide 7. Thereafter, the drive motor 17 of the wire binding device 4 rotates, and this rotation is transmitted from the planet cage 27 to the tip end shaft 12 via the speed reducer 18. The tip end shaft 12 rotates, however, the short sleeve 16 coupled integrally to the main sleeve 11 cannot rotate due to the long fin 33 engaging with the rotation stoppers 35 when it is at the standby position as described above. Therefore, as shown in FIG. 5, the key 15 of the main sleeve 11 is fed forward by the screw groove 14 of the tip end shaft 12 rotating, so that main sleeve 11 advances. When only the main sleeve 11 advances, the hooks 10 move to both sides of the wire portion. On the other hand, the shaft body 21 moves rearward relative to the main sleeve 11. Therefore, the guide pin 22 of the shaft body 21 actuates the hooks 10 to close, and move along the guide groove 26 of the hooks 10, and grasp a part w of the wire loop.

In the middle of advancing of the main sleeve 11, the cutter ring 32 pushes and turns the cutter lever 43, so that the cutter (not shown) is actuated to cut the wire. When the main sleeve 11 advances to this stage, the long fin 33 of the short sleeve 16 comes off the rotation stoppers 35 of FIG. 4, and the key 15 also reaches the end portion of the screw groove 14, so that the tip end shaft 12 and the main sleeve 11 integrally rotate by a predetermined number of rotations, and are actuated to twist the grasped wire.

Figure 6:
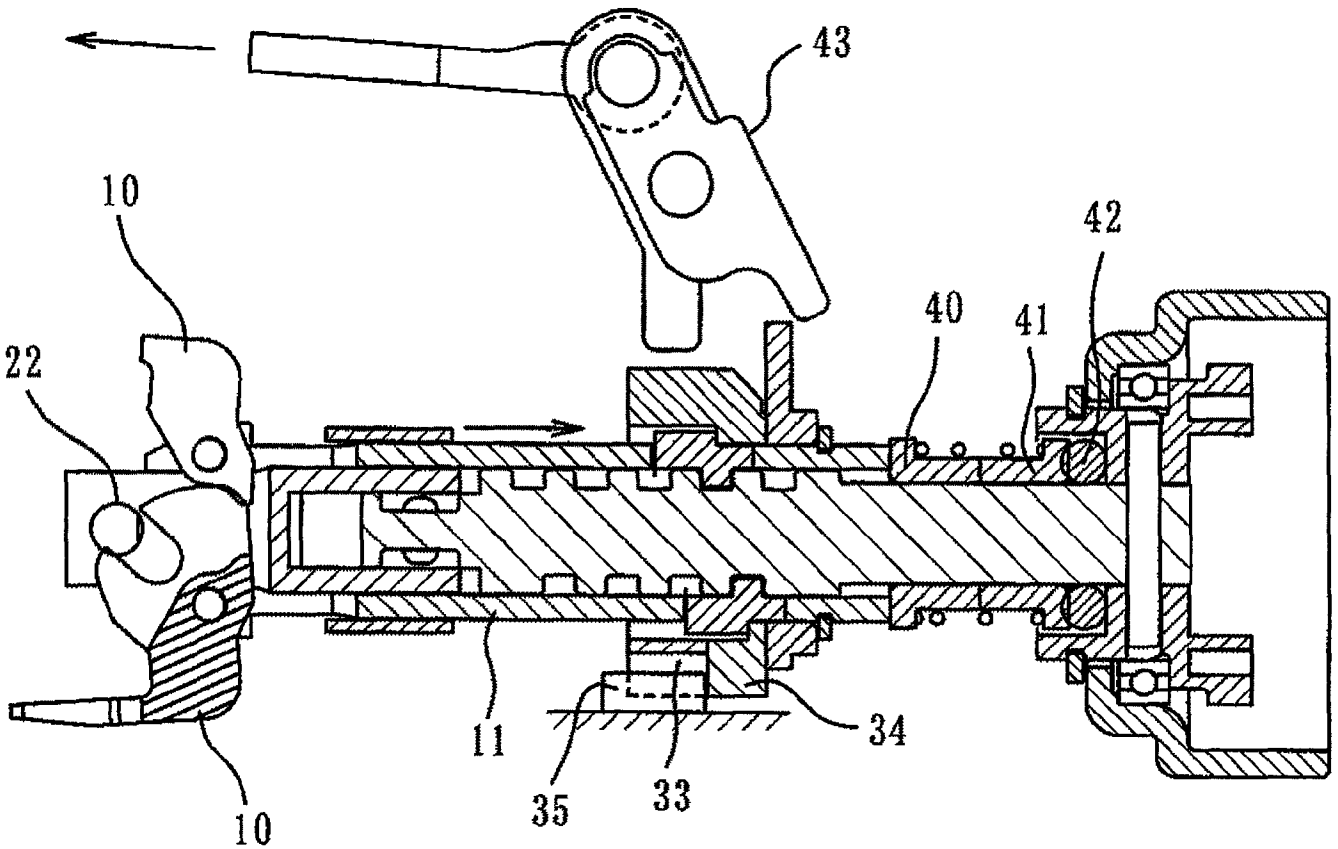
FIG. 6 is a sectional view showing a state where a main sleeve retreats after twisting a wire.

When twisting is finished, the drive motor 17 is rotated in reverse, and the tip end shaft 12 rotates in reverse. Accordingly, the main sleeve 11 also rotates while moving rearward, however, the short fin 34 of the short sleeve 16 engages with the rotation stoppers 35, so that the main sleeve 11 cannot rotate further but retreats, and as shown in FIG. 6, the hooks 10 open and release the wire. At this timing, the short fin 34 comes out from the rotation stoppers 35 as shown in the figure, and the main sleeve 11 becomes rotatable until the long fin 33 comes into contact with the rotation stoppers 35. However, when the grease applied between the main sleeve 11 and members of the reinforcing bar binding machine main body 1 side runs out or absorbs debris and fugitive dust and deteriorates the lubricating function, actuation between these members loses smoothness and the frictional force between the main sleeve 11 and these members increases. Because of this frictional force which suppresses the rotation, if the main sleeve continuously retreats, the main sleeve 11 collides with the spring collar 40, and finally, the spring collar 40 collides and unifies with the spring collar 41, and further, the spring collar 41 collides with the bumper 42 and compresses the bumper 42. The bumper 42 is compressed and brings the spiral screw groove 14 of the tip end shaft 12 into pressure contact with the key 15 of the main sleeve 11. The bumper 42 has rigidity higher than that of a conventional compression spring, so that the compression load of the bumper 42 is much higher than that of a spring, and can cause a great frictional force between the spiral screw groove 14 of the tip end shaft 12 and the key 15 of the main sleeve 11. The rotation of the tip end shaft 12 is transmitted to the main sleeve 11 via the key, the bumper 42, and the spring collars 40 and 41, and due to this frictional force, the tip end shaft 12 and the main sleeve 11 reliably rotate together, and the long fin 33 of the main sleeve 11 engages with the rotation stoppers 35 and sets the orientations of the hooks 10 at correct standby angles. The cutter ring 32 also turns into an initial state.

With the bumper 42, the main sleeve 11 collides at a certain speed and decelerates. The higher the speed of collision, the higher the workability, however, if the speed is excessively high, an impact is applied to components such as the screw groove 14, the key 15, and the planet cage 27 and may break these. Therefore, as described below, by controlling the number of rotations of the drive motor immediately before the collision with the bumper 42, the speed of collision with the bumper 42 is controlled and reduced to some degree.

In other words, to minimize the time during which the tip end shaft 12 rotates in reverse and the main sleeve 11 retreats and returns to the standby position together with the short sleeve 16, after the main sleeve 11 retreats and the short fin 34 is disengaged from the rotation stoppers 35 and 35, brake control is performed to reduce the speed of the drive motor 17 of the tip end shaft 12 to a low rotation speed so that the main sleeve 11 collides with the bumper 42 at the low speed of the controlled number of rotations.

Figure 7:
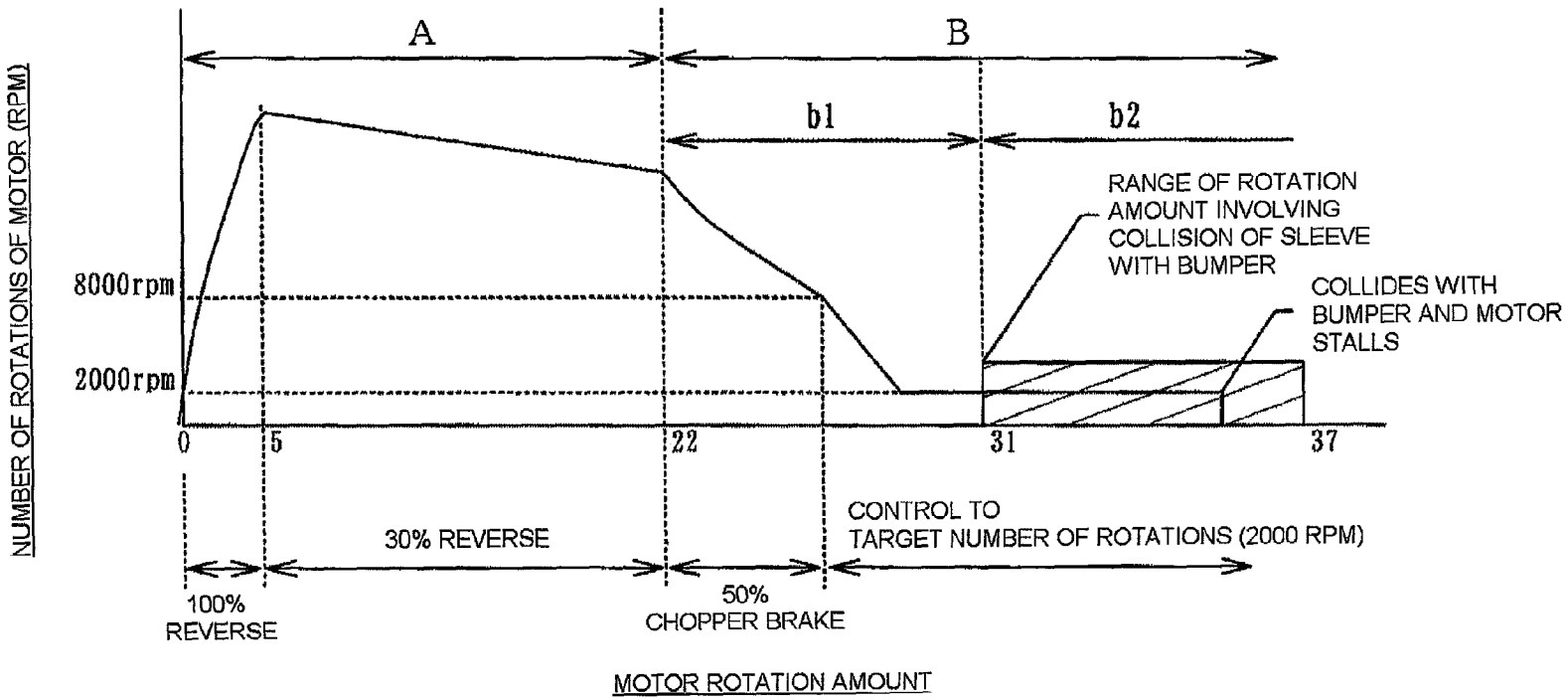
FIG. 7 is a rotation control diagram of a drive motor showing control for coping with standby angle deviation of hooks.

In detail, as shown in FIG. 7, the range in which the short fin 34 of the short sleeve 16 engages with the rotation stoppers 35 and 35 after the drive motor 17 starts rotating in reverse, and opens the hooks 10 without rotating the hooks 10 to release the wire, that is, a first movement range A in which the short fin 34 engages with the rotation stoppers 35 and 35 and the hooks 10 never rotate, and a second movement range B in which the short fin 34 is disengaged from the rotation stoppers 35 and 35 and the hooks 10 rotate and return to the orientations of the standby state, are set, and in the respective ranges A and B, the rotation of the drive motor 17 is controlled as shown in the same figure.

The longitudinal axis of the figure indicates the number of rotations of the drive motor 17, and the horizontal axis indicates the rotation amount of the drive motor 17 and the movement amount of the sleeve (main sleeve 11 and short sleeve 16). The first movement range is when the tip end shaft 12 is at the front end position until just after the drive motor 17 starts rotating in reverse, and until the rotation amount of 5 rotations of the motor, the rotation is controlled so that the drive motor 17 rotates with an output (power supply ratio) of 100%. Until the following 22 rotations of the motor, the output is controlled to approximately 30%, that is, the rotation is controlled to rotation by inertia.

The second movement range B is divided into a range b1 until 31 rotations of the motor involving a possibility that the sleeve (11, 16) collides with the bumper 42, and a range b2 until subsequent 37 rotations of the motor during which the sleeve collides with the bumper 42 and stalls.

Until 31 rotations of the motor, the number of rotations of the drive motor 17 is braked at approximately 50% to approximately 8000 rpm by a chopper brake, and further controlled and reduced to approximately 2000 rpm. The reason for chopper control of the current is to suppress heating. The wire twisting operation is repeated many times, and if full braking is performed for each wire twisting operation, great heating occurs.

Thereafter, when the sleeve which is retreating collides with the bumper 42, as shown in the movement range b2, the drive motor 17 is controlled and held at the fixed number of rotations (2000 rpm) and then stalls. The load when the drive motor 17 stalls is detected by monitoring the current or number of rotations and detecting a change in current or number of rotations. When the bumper 42 is compressed and the frictional resistance between the tip end shaft 12 and the sleeve increases, the sleeve rotates together with the tip end shaft 12, and the long fin 33 engages with the rotation stoppers 35 and 35, and the orientations of hooks 10 can be stopped at correct angles.

As described above, a structure is formed in which the key 15 of the main sleeve 11 is engaged with the spiral screw groove 14 of the tip end shaft 12, and the drive motor 17 which rotates the tip end shaft 12 is a brushless motor including a rotation sensor installed inside, so that the position of the sleeve can be known from a rotation amount based on the number of rotations of the motor. The rotation amount of the drive motor 17 from when the sleeve retreats from the forefront portion until the sleeve collides with the bumper 42 is fixed. Therefore, all of the first movement range A, the second movement range B, and the range involving a possibility that the sleeve collides with the bumper 42, etc., can be calculated from the rotation amount of the drive motor 17. Therefore, according to the position of the main sleeve 11, by controlling the drive motor 17 so that it is rotated at a high speed until the last moment before the sleeve collides with the bumper 42, and just before the sleeve collides with the bumper 42, the number of rotations is reduced to a target number of rotations, without losing the operation swiftness, while the impact is minimized, the durability of components can be improved. In an experimental example, the operation time when the main sleeve 11 was collided with the bumper 42 at a low rotation speed of 2000 rpm was 1 sec, and on the other hand, the operation time under control as described above was 0.2 to 0.3 msec.

Even when the drive motor is a brushless motor, by providing a rotation sensor, the same control can be performed. Instead of stopping of the motor by detecting a stall, it is also possible that the rotation of the motor is stopped before it stalls by detecting a torque of the motor which increases when the bumper is compressed by monitoring the current or number of rotations.

As described above, according to the twisting device described above, as a sleeve to which the tip end shaft 12 is fitted, only one main sleeve 11 is sufficient, so that the structure becomes simple and slim, so that the size and weight can be reduced.

Transmission of a load from the tip end shaft 12 to the hooks 10 can be made in the order of the tip end shaft 12, the key 15, the main sleeve 11, and the hooks 10, so that only two components are interposed. In addition, the main sleeve 11 and the short sleeve 16 are integrally engaged with each other, and unlike the conventional configuration, there is no need to fix these with a fixing tool, so that the fixing tool interposed between the two inner and outer sleeves of the conventional configuration becomes unnecessary, and a high load can be transmitted by a simple structure.

Further, the bumper 42 is provided on the outer periphery of the main sleeve 11, and comes into contact with the main sleeve 11 via the spring collars 40 and 41, so that the contact area between the bumper 42 and the spring collars 40 and 41 can be secured large when the main sleeve 11 retreats, so that an impact can be satisfactorily absorbed.

Additionally, the compression spring 37 is engaged with the outside of the spring collars 40 and 41 fitted to the tip end shaft 12, so that the thickness of the compression spring 37 can be freely changed to obtain an optimum spring force.

Further, according to the structure shown in FIG. 3, a sleeve guide 39 serving as a bearing portion of the main sleeve which advances and retreats and rotates can be inserted from the rear side of the main sleeve, so that the sleeve guide can be formed into a ring shape and simplified. Further, the sleeve guide can be inserted from the rear side, so that a hook attaching portion required to have strength can be made larger than the inner diameter of the sleeve guide, and the structure can be made strong and slim.

According to the above-described configuration, even when grease applied between the sleeve and members of the reinforcing bar binding machine main body side runs out or absorbs debris and fugitive dust and deteriorates the lubricating function and loses the smoothness of the actuation between these members, by a simple structure, the sleeve and the tip end shaft 12 can be reliably rotated together to return the hooks 10 to the standby positions, and the hooks 10 can be set in predetermined orientations at standby angles.

The conventional compression spring for increasing the frictional force becomes unnecessary, so that the number of components can be reduced, and according to the space of the reduced components, the entire length is shortened and downsizing is realized.

Further, return to the predetermined positions of the sleeve and the tip end shaft can be detected by monitoring a change in current or number of rotations in the movement range b2 of FIG. 7, so that the position detection sensor using a magnetic sensor, etc., becomes unnecessary, and the mechanism can be simplified and downsized.

Without providing the compression spring 37 and the spring collars 40 and 41, the main sleeve 11 and the bumper can be brought into direct contact with each other, and in this case, a frictional force also occurs between the main sleeve 11 and the planet cage 27 via the bumper, so that this frictional force also has a function for rotating the tip end shaft 12 and the main sleeve 11 together.

On the tip end shaft 12, the member which receives the bumper 42 is not limited to the planet cage 27. It is also possible that an annular jutting part (not shown) other than the planet cage 27 is formed integrally with the base portion of the tip end shaft 12 so as to receive the bumper 42.

The member which is collided with the bumper 42 when the sleeve retreats is not limited to the sleeve itself. Another sleeve may collide with the bumper as long as it can increase the frictional force between the screw groove 14 of the tip end shaft 12 and the key 15 finally by compressing the bumper 42.

Further, the short sleeve 16 may be configured by a short sleeve main body 16*m* and a stopper sleeve 45, and the outside of the key 15 may be covered by a stopper sleeve 45.

In this case, preferably, projections 47 are formed on both ends of the stopper sleeve 45, and these projections 47 are engaged with a rib 48 formed on the outer periphery of the main sleeve 11 and a receiving groove 46 of the short sleeve main body 16*m*, respectively, so that the main sleeve 11 and the short sleeve 16 rotate integrally.

Further, integral engagement between the main sleeve 11 and the short sleeve 16 is not limited to direct engagement. As described above, it is also possible that these are engaged via a stopper sleeve 45.

In this case, it is also possible that on both ends of the stopper sleeve 45, projections 47 are formed, and these projections 47 are engaged with a rib 48 formed on the outer periphery of the main sleeve 11 and a receiving groove 46 of the short sleeve main body 16*m*, respectively, so that the main sleeve 11 and the short sleeve 16 rotate integrally.

Figure 9B:
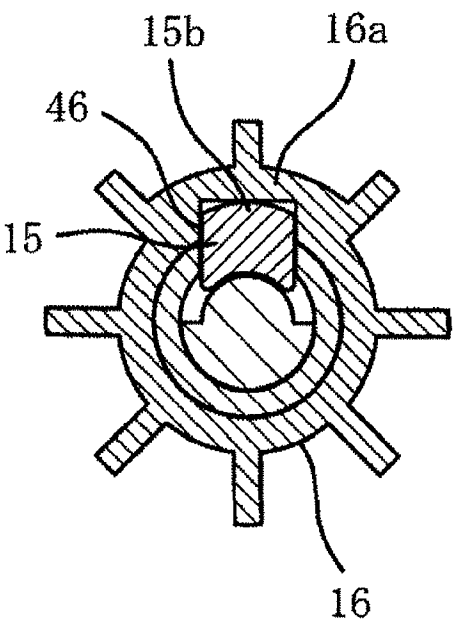
FIG. 9(*a*) is a sectional view of still another embodiment of a measure for preventing the key from coming out, and FIG. 9(*b*) is a sectional view along the Y-Y line of FIG. 9(*a*)
Figure 9A:
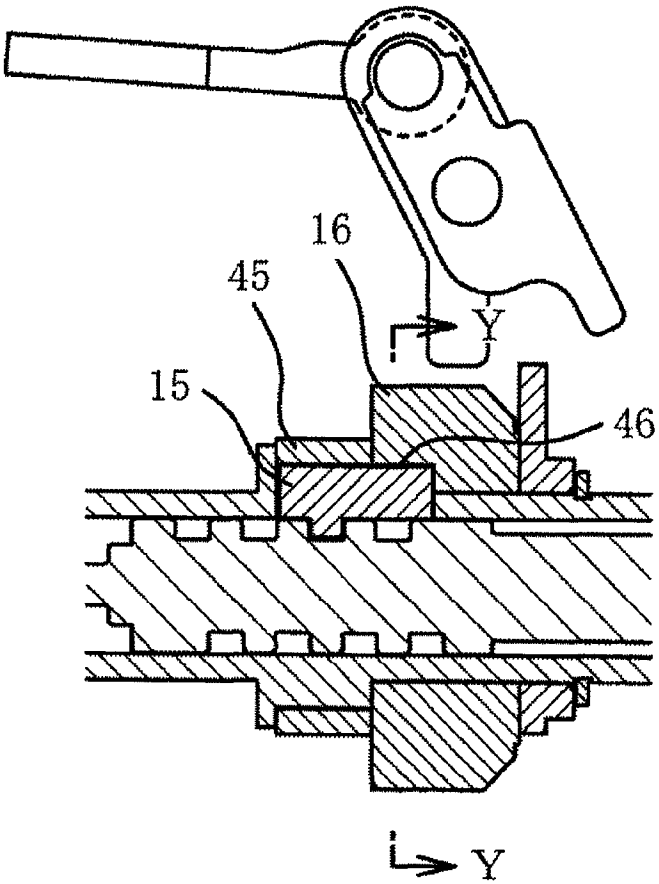

Similarly, as shown in FIG. 9(*a*) and FIG. 9(*b*), as a configuration for engaging the main sleeve 11 and the short sleeve 16 integrally, it is also possible that the convex portion 15*b* of the key 15 is engaged with the receiving groove 46 of the short sleeve 16. Preferably, the portion 16*a* corresponding to the receiving groove 46 of the short sleeve 16 is made thick to secure strength.

Figure 10:
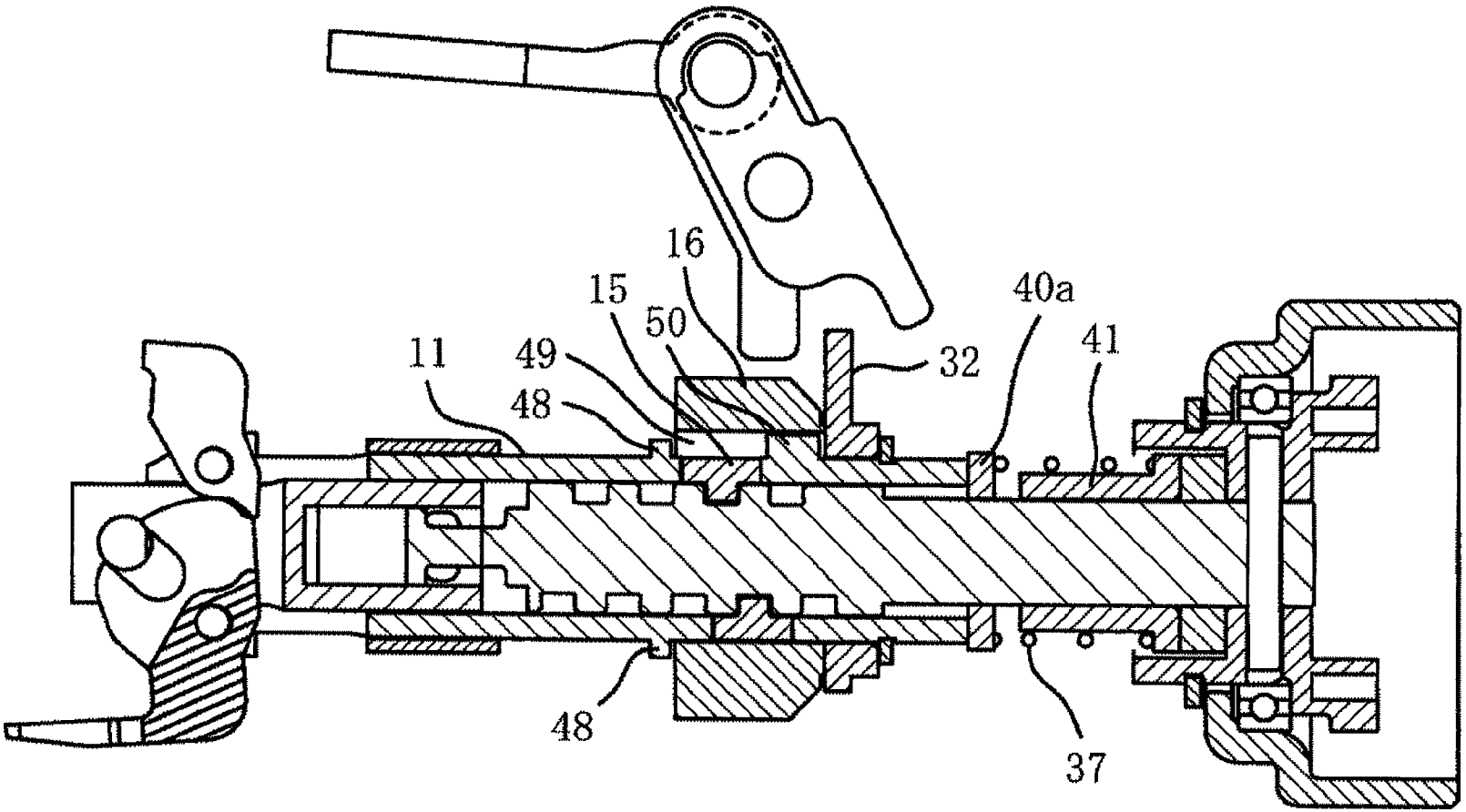
FIG. 10 is a sectional view showing a key coupling state between the main sleeve and the short sleeve.
Figure 11:
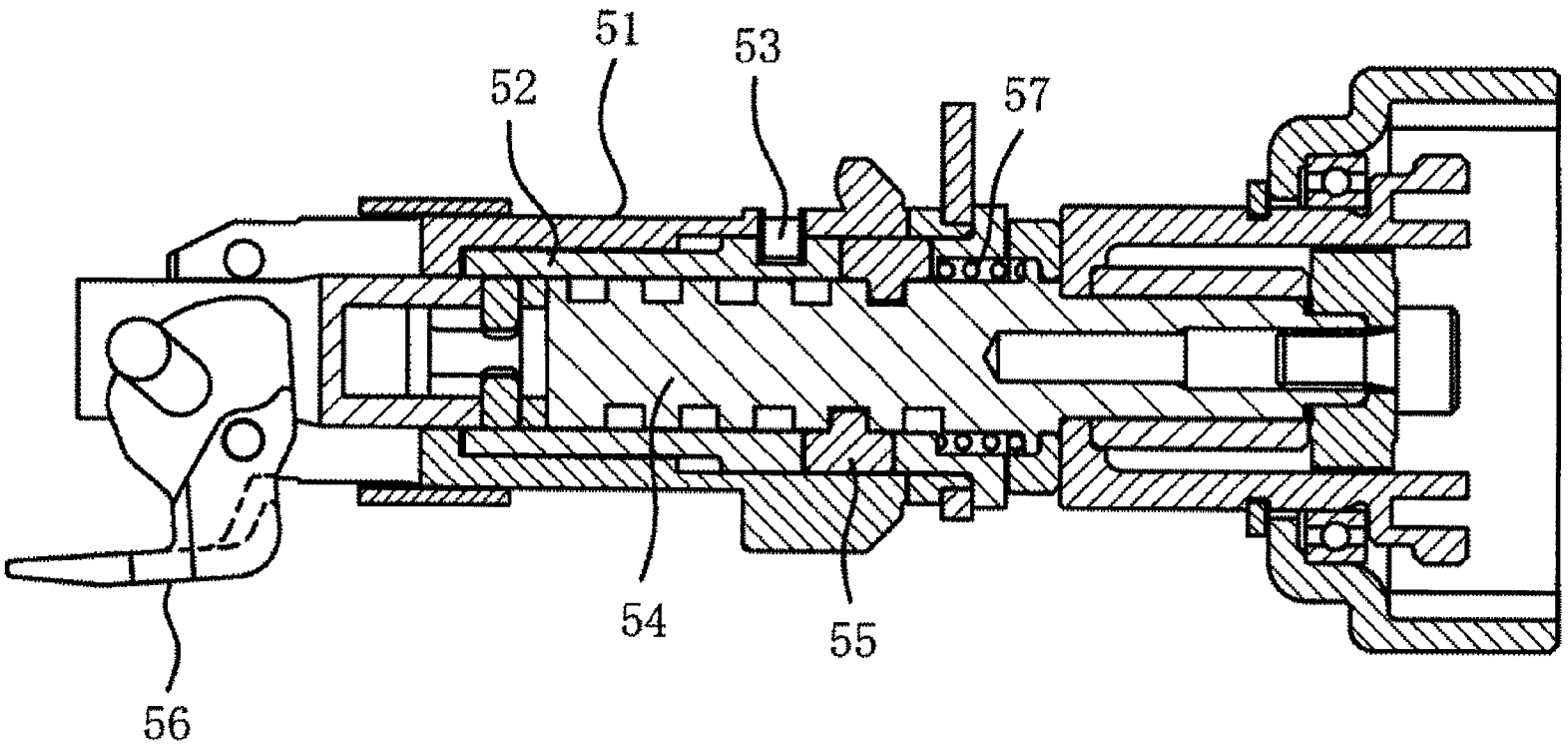
FIG. 11 is a sectional view showing a conventional twisting device.

Further, as shown in FIG. 10, it is also possible that a key 50 is formed so as to project from the outer peripheral surface of the main sleeve 11 and the key 50 is engaged with a screw groove 49 formed on the inner surface of the short sleeve 16 so that the main sleeve 11 and the short sleeve 16 are engaged and rotated integrally.

Figure 8:
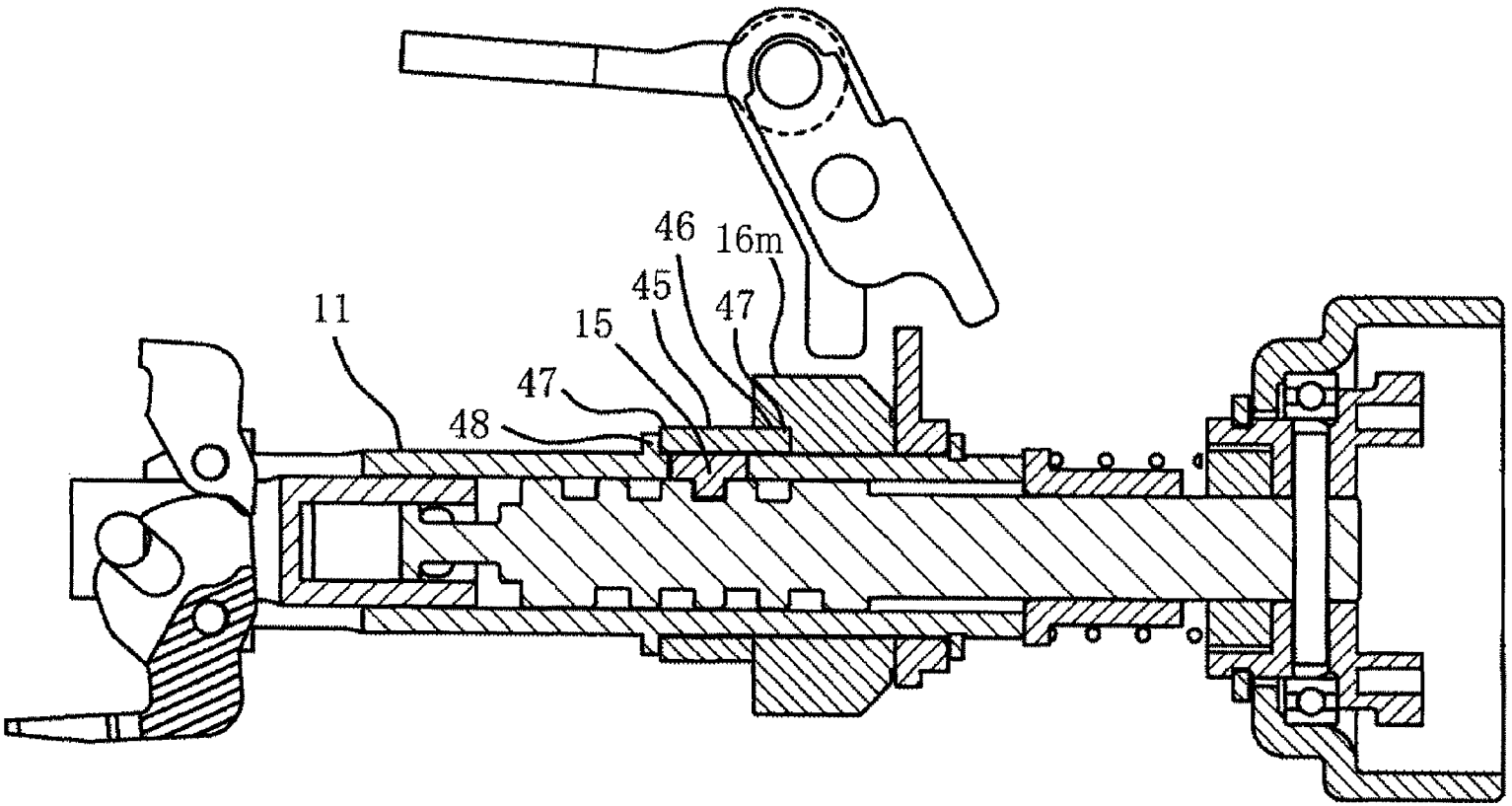
FIG. 8 is a sectional view of another embodiment of a measure for preventing the key from coming out.

Further, in the case of FIG. 8, FIGS. 9(*a*) and 9(*b*), and FIG. 10, by forming the sleeve guide 39 of a combination of semicircles, it guides the main sleeve while maintaining it slim.

The key 50 and the short sleeve 16 are sandwiched between a rib formed on the outer periphery of the main sleeve 11 and the cutter ring 32 and held so as not to move forward and rearward.

The compression spring 37 may be supported between a washer 40*a* at the rear end of the main sleeve 11 and the rear spring collar 41 as shown in FIG. 10.

While description has been made in connection with specific exemplary embodiment of the invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

10 Hook
11 Main sleeve
12 Tip end shaft
14 Screw groove
15 Key
16 Short sleeve
27 Planet cage (jutting part)
33 Long fin (engaging means)
34 Short fin (engaging means)

What is claimed is:

1. A reinforcing bar binding machine comprises:
- a main sleeve having a tip end on which a hook is pivotally mounted;
- a tip end shaft fitted in an inside of the main sleeve;
- a spiral screw groove formed on the tip end shaft;
- a fitting opening that penetrates from an outside to the inside of the main sleeve;
- a key fitted in the fitting opening and brought in mesh engagement with the screw groove;
- a short sleeve provided on an outer periphery of the main sleeve and covering the key; and
- engaging means formed on the short sleeve and controlling a rotation of the main sleeve.

2. The reinforcing bar binding machine according to claim 1, wherein the short sleeve comprises a short sleeve main body and a stopper sleeve, and an outer side of the key is covered by the stopper sleeve.

3. The reinforcing bar binding machine according to claim 2, wherein front and rear ends of the stopper sleeve respectively engage with a rib formed on the outer periphery of the main sleeve and the short sleeve.

4. The reinforcing bar binding machine according to claim 1, wherein the main sleeve and the short sleeve are engaged with each other by key coupling.

5. The reinforcing bar binding machine according to claim 1, further comprising a cutter ring which fits on the outer periphery of the main sleeve and actuates a cutter of a wire, wherein the cutter ring is sandwiched and fixed between the short sleeve and a stopper ring attached on the main sleeve.

6. The reinforcing bar binding machine according to claim 1, further comprising:

a spring collar fitting on the tip end shaft; and a compression spring provided between a planet cage coupled to a rear end of the tip end shaft for rotatably supporting a planet gear configuring a speed reduction mechanism of a drive motor and a rear end of the main sleeve, and disposed on an outer side of the spring collar.

7. The reinforcing bar binding machine according to claim 6, wherein the planet cage and the tip end shaft are coupled by a parallel pin, and the parallel pin is prevented from coming out by a bearing portion of the planet cage.

8. The reinforcing bar binding machine according to claim 6, further comprising a bumper provided between the planet cage and a rear spring collar.

9. A reinforcing bar binding machine comprising:

a sleeve having a tip end on which a hook is pivotally mounted;

a long fin which is long in an axial direction of the sleeve and a short fin which is short in the axial direction, the long and short fins being formed on the sleeve at intervals in a circumferential direction of the sleeve;

a tip end shaft fitted in an inside of the sleeve;

a spiral screw groove formed on the tip end shaft;

a fitting opening that penetrates from an outside to the inside of the sleeve;

a key fitted in the fitting opening and brought in mesh engagement with the screw groove;

a rotation stopper provided on a binding machine body and engageable with the long and short fins; and a bumper provided between a jutting part provided on a base portion of the tip end shaft and an end face of the sleeve;

wherein, when the long fin engages with the rotation stopper, the sleeve advances with respect to the tip end shaft by a rotation of the tip end shaft so that the hook grasps a wire, wherein, when the sleeve retreats to a standby position by a reverse rotation of the tip end shaft and the short fin disengages from the rotation stopper, the tip end shaft and the sleeve integrally rotate so that the long fin engages with the rotation stopper to set the hook in a predetermined orientation, wherein, when the sleeve retreats, by a frictional force between the spiral screw groove and the key caused by colliding the sleeve with the bumper, the tip end shaft and the sleeve integrally rotate.

10. The reinforcing bar binding machine according to claim 9, wherein, after the short fin and the rotation stopper are disengaged when the sleeve retreats, the sleeve is collided with the bumper at a controlled fixed number of rotations, and a drive motor is stopped based on a change in current or number of rotations when the bumper is compressed by the collision.

11. The reinforcing bar binding machine according to claim 9, wherein, after the short fin and the rotation stopper are disengaged when the sleeve retreats, a drive motor is controlled to rotate at a low speed immediately before the sleeve is collided with the bumper, and the drive motor is stopped, based on a change in current or number of rotations when the bumper is compressed by the collision.

12. The reinforcing bar binding machine according to claim 9, wherein when the sleeve collides with the bumper, a change in current or number of rotations when the bumper is compressed is monitored, and the drive motor is rotated at a fixed number of rotations and then stopped.

* * * * *